US008731418B2

(12) United States Patent
Hosohara et al.

(10) Patent No.: US 8,731,418 B2
(45) Date of Patent: May 20, 2014

(54) IMAGE FORMING APPARATUS

(75) Inventors: Kazuhiro Hosohara, Kawasaki (JP); Yoshihiro Ito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 353 days.

(21) Appl. No.: 13/300,350

(22) Filed: Nov. 18, 2011

(65) Prior Publication Data

US 2012/0128381 A1 May 24, 2012

(30) Foreign Application Priority Data

Nov. 22, 2010 (JP) ..... 2010-260530
Oct. 13, 2011 (JP) ..... 2011-226027

(51) Int. Cl.
*G03G 15/00* (2006.01)

(52) U.S. Cl.
USPC ..... 399/49; 399/110; 399/114

(58) Field of Classification Search
USPC ..... 399/38, 49, 107, 110–114, 297–303, 399/308
See application file for complete search history.

(56) References Cited

U.S. PATENT DOCUMENTS 7,406,282 B2 * 7/2008 Inui et al. ..... 399/299
7,574,150 B2 * 8/2009 Eom ..... 399/13

FOREIGN PATENT DOCUMENTS

| | | | |
|---|---|---|---|
| JP | 4-184360 | A | 7/1992 |
| JP | 6-130763 | A | 5/1994 |
| JP | 2001-34032 | A | 2/2001 |
| JP | 2001-194853 | A | 7/2001 |
| JP | 2007-121983 | A | 5/2007 |
| JP | 2008-209898 | A | 9/2008 |
| JP | 2009-75479 | A | 4/2009 |

* cited by examiner

*Primary Examiner* — Hoan Tran
(74) *Attorney, Agent, or Firm* — Canon U.S.A., Inc., IP Division

(57) ABSTRACT

An image forming apparatus includes a rotatable belt, a detection unit configured to detect, at a detecting position, an object on the belt, a cartridge that is attachable to and detachable from a main body of the apparatus independently of the belt, and an openable and closable member that is openable and closable relative to the body to attach and detach the cartridge to and from the body. When the detection unit is at the detecting position, at least a part of the detection unit is located in a space used for attachment and detachment of the cartridge, and, when the detection unit is at a retracted position, which is outside of a space used for attachment and detachment of the cartridge, at least a part of the detection unit is located in a space that is formed by opening the openable and closable member relative to the body.

10 Claims, 10 Drawing Sheets

IMAGE FORMING APPARATUS

BACKGROUND OF THE INVENTION

1. Field of the Invention

The present invention relates to an image forming apparatus that uses at least one cartridge and forms images on recording media in an electrophotographic method.

2. Description of the Related Art

Conventionally, there have been image forming apparatuses that form an image by transferring toner images in a plurality of colors from photosensitive drums to an intermediate transfer belt individually in sequence, and then transferring the combined toner image on the intermediate transfer belt to a recording medium. In such apparatuses, any misalignment of a toner image transferred from a photosensitive drum to an intermediate transfer belt from a predetermined position may lead to color misregistration, resulting in poor image quality. In addition, any difference in toner density between the colors on the intermediate transfer belt may cause difference in hue as well as color misregistration, which also results in poor image quality. Accordingly, a detection unit configured to detect the position and density of each toner image on the intermediate transfer belt is located opposite the intermediate transfer belt.

Japanese Patent Application Laid-Open No. 2001-194853 discusses a detection unit and the detection of toner images. The detection unit is disposed opposite a roller where the intermediate transfer belt is stretched around so that a detection defect is not caused due to sagging and flapping of the intermediate transfer belt, and the detection unit detects toner images on the part of an intermediate transfer belt that is wound around the roller.

Japanese Patent Application Laid-Open No. 2007-121983 discusses attachment and detachment of cartridges to and from an image forming apparatus, each of the cartridges having a photosensitive drum. The attachment and detachment are respectively achieved by supporting the cartridges by a plurality of pullout trays and pulling out the pullout trays along the direction in which an intermediate transfer belt is stretched.

FIG. 6 illustrates a conventional image forming apparatus 101 that includes a detection unit 261 configured to detect toner images and toner densities on an intermediate transfer belt 131. The intermediate transfer belt 131 is stretched via rollers 151 and 141 in the direction where photosensitive drums 1 are arranged (direction L). A secondary transfer roller 221 is located opposite the roller 141. The image forming apparatus further includes a pullout tray 341 that supports cartridges CRG. The cartridges CRG are pulled out in the direction L with the pullout tray 341 to be removed from the main body of the image forming apparatus. The detection unit 261 is located opposite the roller 151 across the intermediate transfer belt 131, and is disposed outside of the space S where the cartridges CRG pass to be attached to and detached from the apparatus.

As described above, the conventional image forming apparatus separately includes a space for attachment and detachment of cartridges and a space for a detection unit, which preclude downsizing of the image forming apparatus.

SUMMARY OF THE INVENTION

The present invention is directed to downsizing of an image forming apparatus.

According to an aspect of the present invention, an image forming apparatus includes: a rotatable belt used to form an image on a recording medium; a detection unit configured to detect, at a detecting position, an object to be detected on the belt; a cartridge including a photosensitive drum and configured to be attachable to and detachable from a main body of the image forming apparatus independently of the belt; and an openable and closable member configured to be openable and closable relative to the main body of the image forming apparatus to attach and detach the cartridge to and from the main body of the image forming apparatus, wherein the detection unit is movable between a retracted position, which is outside of a space used for attachment and detachment of the cartridge, and the detecting position, and wherein, when the detection unit is at the detecting position, at least a part of the detection unit is located in the space used for attachment and detachment of the cartridge, and, when the detection unit is at the retracted position at least a part of the detection unit is located in a space that is formed by opening the openable and closable member relative to the main body of the image forming apparatus.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An image forming apparatus 100 according to a first exemplary embodiment of the present invention is generally described. The term "image forming apparatus" herein refers to an apparatus that forms images on a recording medium in an electrophotographic method. Examples of the image forming apparatus include copying machines, laser beam printers, light-emitting diode (LED) printers, facsimile apparatuses, and word processors. Examples of the recording medium include paper and overhead projector (OHP) sheets.

Figure 1A:
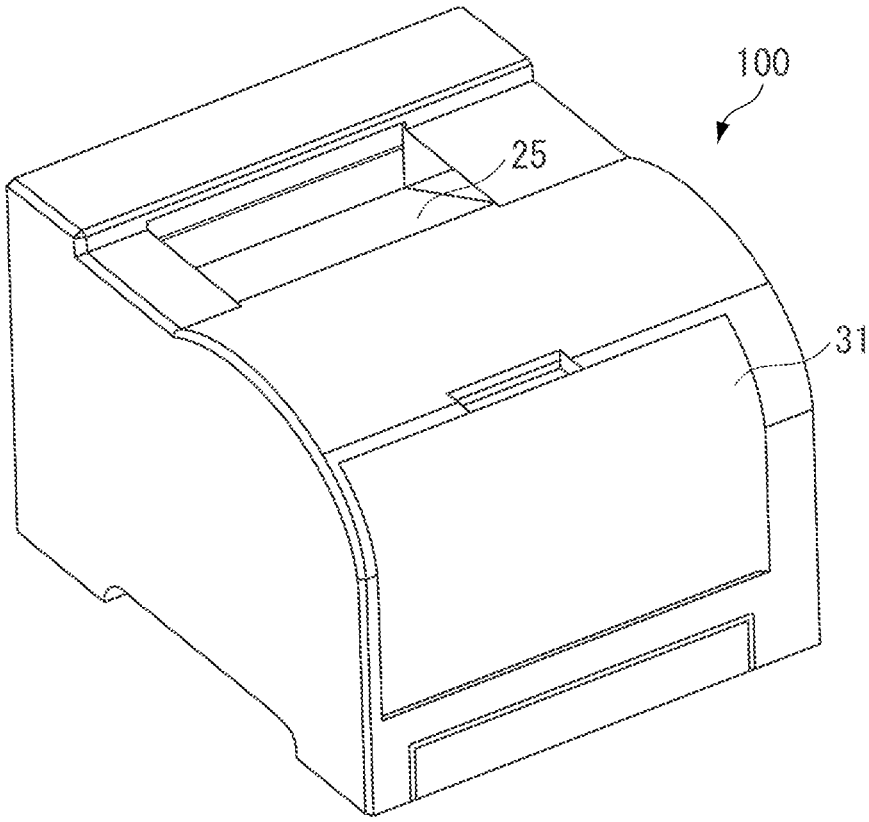
FIG. 1A is an exterior perspective view illustrating an image forming apparatus according to a first exemplary embodiment of the present invention.
Figure 1B:
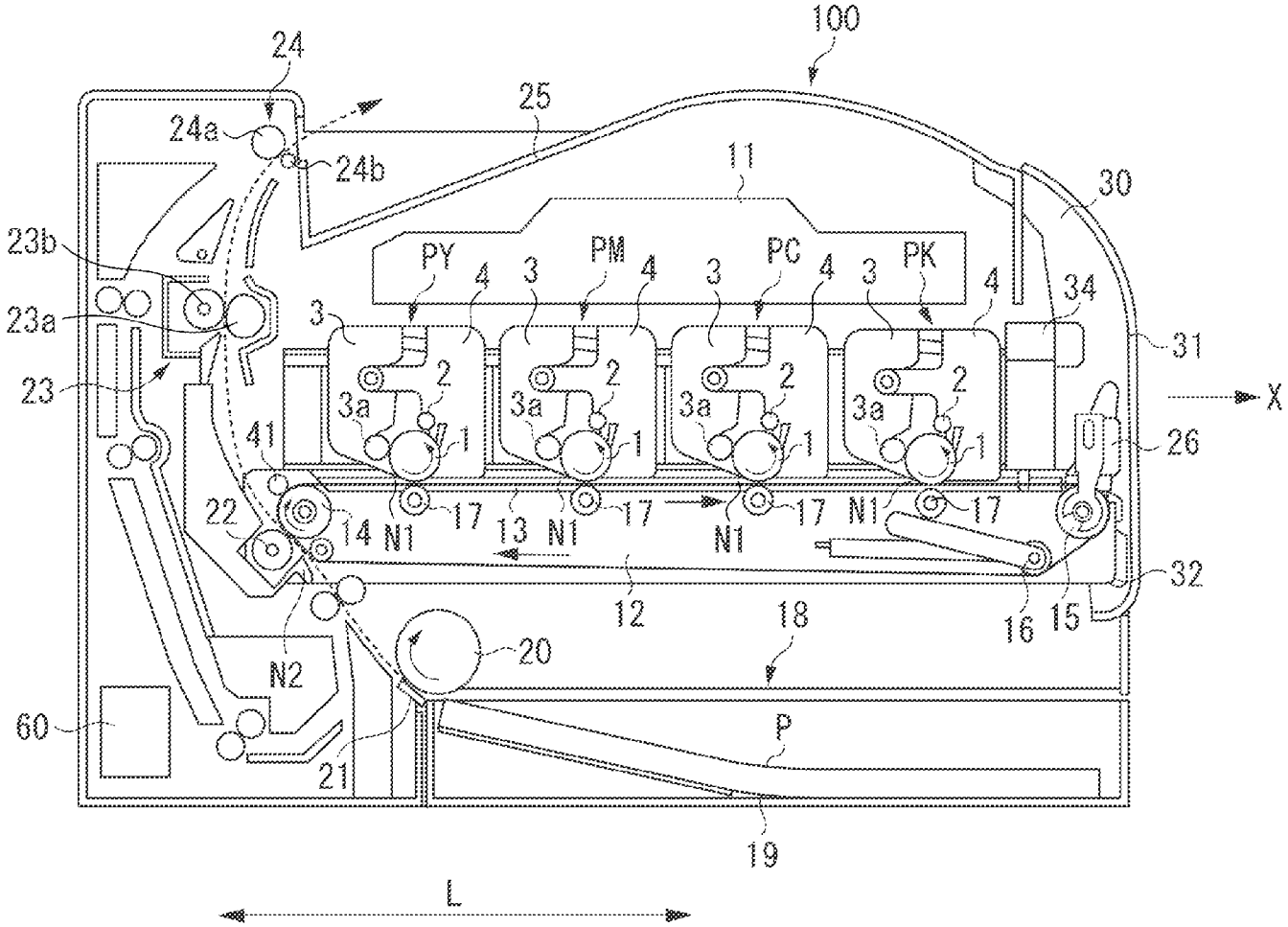
FIG. 1B is a cross sectional view schematically illustrating the image forming apparatus according to the first exemplary embodiment.

FIG. 1A is an exterior perspective view illustrating the image forming apparatus 100 according to the first exemplary embodiment. FIG. 1B is a cross sectional view schematically illustrating the image forming apparatus 100. The image forming apparatus 100 is an electrophotographic laser printer for four colors (full color). The image forming apparatus 100 forms images on a recording medium (transfer-receiving member) P based on image signals input to a controller (control unit) therein from an external host apparatus such as a personal computer, an image reader, and a facsimile apparatus as communication partner. Hereinafter, the image forming apparatus 100 has a front (forward) side with a door 31, a rear (backward) side opposite the front side, and right and left sides as seen from the front side of the apparatus 100.

As illustrated in FIG. 1B, the image forming apparatus 100 has a body in which first to fourth cartridges CRG (PY, PM, PC, PK) are removably mounted in a line horizontally. The cartridges CRG each have a similar configuration except the color of toner stored therein. The cartridges CRG each have a photosensitive drum 1 as an image bearing member, a charging device 2 as a process unit for the photosensitive drum 1, a developing device 3, and a cleaning device 4, these elements being integrally incorporated in a cartridge frame thereof.

The first to fourth cartridges CRG respectively stores yellow (Y), magenta (M), cyan (C), and black (K) toner in the developing device 3 thereof. The first to fourth cartridges CRG are attached to and detached from the main body of the image forming apparatus when the door 31 as an openable and closable member is rotated along a door hinge 32 so that the interior of the apparatus become accessible through an opening 30.

Above the first to fourth cartridges CRG, a scanner unit 11 is provided as an exposure unit. The scanner unit 11 outputs a laser beam that is modulated in response to image information input from an external host apparatus, so that the laser beam scans and exposes the photosensitive drum 1 of each of the cartridges.

Below the first to fourth cartridges CRG, an intermediate transfer belt unit 12 is provided. The belt unit 12 includes a flexible endless belt 13 as an intermediate transfer member, a driving roller 14, a turning roller 15, and a tension roller 16, the rollers stretching and rotating the belt 13. The turning roller 15 is disposed in the front side of the body of the apparatus 100. Hereinafter, the term "belt stretching direction" refers to the direction in which the belt 13 is mainly stretched. The belt stretching direction of the present exemplary embodiment is the one along which belt 13 is mainly stretched and also the driving roller 14 and the turning roller 15 are arranged in line in the apparatus 100.

The first to fourth cartridges CRG are arranged in the belt stretching direction, and the photosensitive drum 1 of each of the cartridges CRG has a lower surface disposed in contact with the upper surface of the upper portion of the stretched belt 13. Four primary transfer rollers 17 are arranged on the lower surface of the upper portion of the belt 13, so that the primary transfer rollers 17 are located between the upper and lower portions of the belt 13, and disposed respectively opposite the photosensitive drums 1 of the cartridges CRG through the upper portion of the belt 13. The four pairs of the photosensitive drum 1 and the primary transfer roller 17 constitute a primary transfer nip portion N1 that sandwiches the upper portion of the belt 13 therebetween. The primary transfer roller 17 may be a primary transfer pad of an elastic material.

The driving roller 14 is disposed opposite a secondary transfer roller 22 across the belt 13, and thereby the pair of the driving roller 14 and the secondary transfer roller 22 constitutes a secondary transfer nip portion N2 that sandwiches the belt 13 therebetween. Above and opposite the driving roller 14, a member 41 is disposed to clean toner from the belt 13. In the present exemplary embodiment, the cleaning member 41 is a charging roller that charges any residual toner on the belt 13.

Opposite the turning roller 15 across the belt 13, a detection unit 26 configured to detect toner on the belt 13 is supported by a support member 27.

Below the belt unit 12, a paper feeding unit 18 is provided. The paper feeding unit 18 includes a paper feed tray 19, a paper feed roller 20, and a separation pad 21. The paper feed tray 19 is insertable to and removable from the apparatus body through the front side of the apparatus 100.

In the upper part of the rear side of the apparatus body, a fixing device 23 and a pair of discharge rollers 24 are provided. The apparatus body is covered with a paper discharge tray 25 at the top thereof. The fixing device 23 includes a fixing film assembly 23*a* and a pressing roller 23*b*. The pair of discharge rollers 24 includes a paper discharge roller 24*a* and a paper discharge wheel 24*b*.

The cartridges at respective fixing positions in the apparatus body are each coupled to a drive output unit of the apparatus through a drive input unit of the cartridge. The cartridges are each electrically connected to a power supply system of the apparatus body at electrical contacts of the cartridge.

Operations to form a color image on a recording medium P is described. The photosensitive drum 1 of each of the first to fourth cartridges CRG is driven to rotate in the direction indicated by the arrow in FIG. 1B. The belt 13 is also driven to rotate in the direction indicated by the arrow (the forward direction relative to the rotation of the photosensitive drum 1). In each cartridge CRG, the photosensitive drum 1 is charged over its surface uniformly by the charging roller 2 at predetermined timings to cause the surface to have a predetermined polarity and potential. The scanner unit 11 scans and exposes the surface of the photosensitive drum 1 with a laser beam that is modulated according to an image signal for each color. As a result, the area scanned and exposed with the laser beam on the surface of the photosensitive drum 1 is turned to be an electrostatic latent image corresponding to the image signal. The electrostatic latent image on the surface of the photosensitive drum 1 is developed into a toner image by the developing device 3 of each cartridge CRG.

Through the electrophotographic image forming process, the photosensitive drum 1 of the first cartridge PY has a yellow toner image formed thereon, and the toner image is primarily transferred to the belt 13. The photosensitive drum 1 of the second cartridge PM has a magenta toner image formed thereon, and the toner image is primarily transferred to the belt 13 to be superimposed on the Y toner image on the belt 13. Similarly, the third and fourth cartridges PC ad PK have a C toner image and a K toner image on the photosensitive drum 1 respectively, and the toner images are primarily transferred to the belt 13 to be superimposed in sequence on the Y and M toner images on the belt 13. In this way, an unfixed toner image in full color (i.e., Y+M+C+K) is formed on the belt 13.

Meanwhile, at a predetermined control timing, a feeding roller 20 is driven. The feeding roller 20 then cooperates with a separating pad 21 to feed separately a sheet of paper P that is one of recording media stuck on the paper feed tray 19 to the secondary transfer nip portion N2. Accordingly, while the recording medium P is fed through the secondary transfer nip portion N2 while sandwiched therebetween, the superimposed toner image in four colors on the belt 13 is transferred to the paper P at one time, which is performed in sequence for a plurality of images.

The recording medium P is then separated from the surface of the belt 13, and is conveyed to the fixing device 23 to be heated and pressed by a fixing nip portion, so that the toner image is fixed to the recording medium P. The conveyed recording medium P exits the fixing device 23 to be discharged onto the paper discharge tray 25 by the pair of discharge rollers 24.

The belt 13, after passing the secondary transfer nip portion N2, has secondary transfer residual toner thereon. The residual toner is charged by the charging roller, which is the member 41 to clean residual toner on the belt 13. The charged toner is electrostatically attracted to the surface of the photosensitive drum 1 at the primary transfer portion of the first process cartridge PY, and removed by the cleaning device 4. In the present exemplary embodiment, the member 41 to clean residual toner on the belt 13 is a charging roller that charges toner on the belt 13, so that the charged toner is collected at the photosensitive drum 1. The member 41 to clean residual toner on the belt 13 may be any other member such as a blade that scrapes toner off from the belt 13.

The detection unit 26 configured to detect an object (an object to be detected) on the belt 13 is described. The detection unit 26 according to the present exemplary embodiment is configured to detect toner on the belt 13, and has a registration detection sensor and a density detection sensor therein.

The registration detection sensor is an optical sensor that is configured with a light emitting diode (LED) as a light emitting unit and a photo diode as a light receiving unit. The registration detection sensor illuminates a registration detection pattern A in a toner image formed on the belt 13 (see FIG. 2A) with a light beam emitted from the LED, and detects an amount of light reflected from the pattern A and received at the photo diode. Based on the amount of the received light, the amount of misregistration relative to a reference color is detected. Based on the detection result, a control unit 60 changes the timing to trigger a laser beam to the photosensitive drums 1 according to the amount of misregistration, and corrects color misregistration. In other words, for example, the registration detection sensor detects positional deviations of M, C, and K sample toner images based on the position of a Y reference sample toner image. According to the detected deviations, the registration detection sensor adjusts the position of a folding mirror in the scanner unit 11, adjusts the position of a laser beam that exposes the photosensitive drums 11, and/or changes the timing to trigger a laser beam, so that the positional deviations of the toner images in the colors are corrected.

The density detection sensor is an optical sensor that is configured with an LED as a light emitting unit and a photo diode as a light receiving unit, similar to the registration detection sensor. The density detection sensor illuminates a density detection pattern formed on the belt 13 with a light beam emitted from the LED, and detects an amount of light reflected from the pattern and received at the photo diode. Based on the amount of the received light, a toner density on the belt 13 is detected. Based on the detection result, the control unit 60 determines image forming conditions such as appropriate development bias and transfer bias to prevent a change in image density due to degradation of the drums 1, a change in environment, and a deterioration of toner. In other words, for example, the density detection sensor reads the difference in densities of M, C, and K sample toner images based on the position of a Y reference sample toner image, adjusts a development bias and toner density for each color. The above-described correction of positional differences of the toner images by the registration detection sensor and the adjustment of density of the toner images by the density detection sensor are generally performed at predetermined timings such as when the image forming apparatus is started up, when the apparatus is resumed after jamming is removed, and when a predetermined period of time passes after start-up of the apparatus. The control unit 60 includes an operation device such as a central processing unit (CPU).

The location of the detection unit 26 is described below. The cartridges CRG are supported on (accommodated in) the pullout tray 34. The cartridges CRG can be attached into and detached from the apparatus body, by opening the door 31 and pulling out the pullout tray 34 from the body substantially along the direction in which the belt 13 is stretched (the direction X). For the attachment and detachment, the apparatus body has a space where the attachable/detachable members are attached/detached, and the cartridges CRG and the pullout tray 34 move through the space. In the present exemplary embodiment, the detection unit 26 is located such that at least a part of the detection unit 26 is disposed in the space. The detection unit 26 at the position, however, disturbs the attachment and detachment of the cartridges CRG. Thus, in the present exemplary embodiment, the detection unit 26 is arranged to retract to a position that does not disturb the movement of the cartridges CRG when the cartridges CRG are attached into and detached from the apparatus body.

Figure 6:
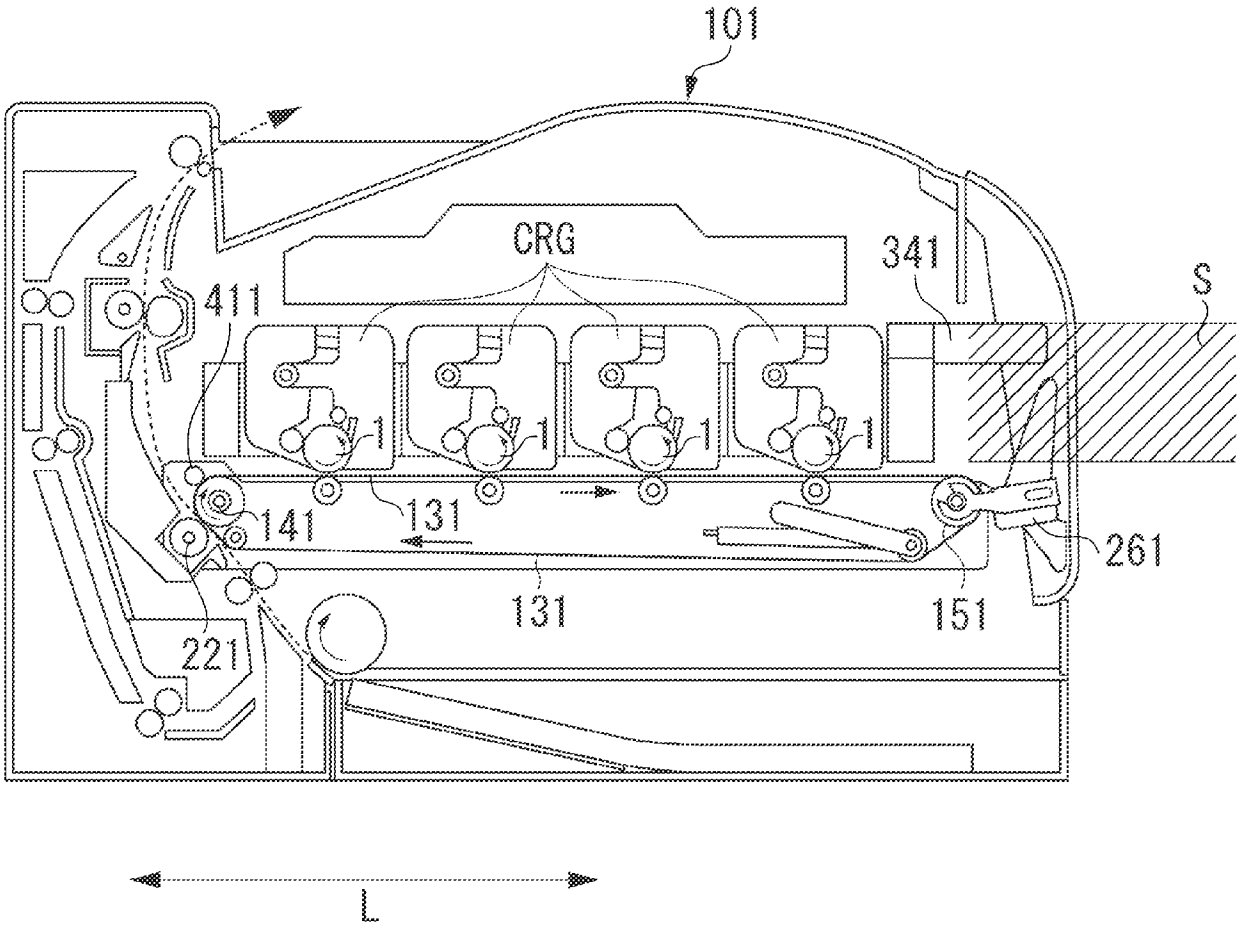
FIG. 6 is a cross sectional view schematically illustrating a conventional image forming apparatus.

If the detection unit 261 is arranged in a conventional image forming apparatus as illustrated in FIG. 6, the apparatus has to have a length increased for at least the length of the detection unit 261 in the direction where the belt 131 is stretched (hereinafter, referred to the direction L). Especially, in the case where the belt is stretched such that the width in the horizontal direction is longer than that in the vertical direction (i.e., the belt is stretched horizontally or at an angle less than 45 degrees relative to the horizontal direction), the apparatus has a length longer in the horizontal direction than in the vertical direction. As a result, the apparatus requires a larger installation area. Thus, in the present exemplary embodiment, the detection unit 26 is arranged at a position that overlaps the belt 13 in the direction L as seen from the axial direction of the roller 15. In other words, the detection unit 26 is arranged to at least partially overlap the belt 13 when the belt 13 and the detection unit 26 are disposed on a horizontal plane.

If the detection unit 26 is disposed below the belt 13, scattered toner impairs the detection accuracy of the detection unit 26. Thus, in the present exemplary embodiment, the detection unit 26 is arranged to be disposed above the belt 13.

The detection unit 26 can detect toner on the belt 13 at high accuracy before the state of the toner changes as little as possible after its primary transfer to the belt 13. Thus, in the present exemplary embodiment, the detection unit 26 is arranged at a position, in the direction the belt 13 rotates, downstream of the most downstream part of the primary transfer nip portion N1 and upstream of the secondary transfer nip portion N2 and the member 41 that cleans residual toner from the belt 13.

The detection unit 26 can be arranged opposite a roller which stretches the belt 13 across the belt 13 so that sagging and flapping of the belt 13 does not change the distance between the detection unit 26 and the belt 13. Thus, in the present exemplary embodiment, the detection unit 26 is arranged opposite the turning roller 15 across the belt 13.

Figure 2A:
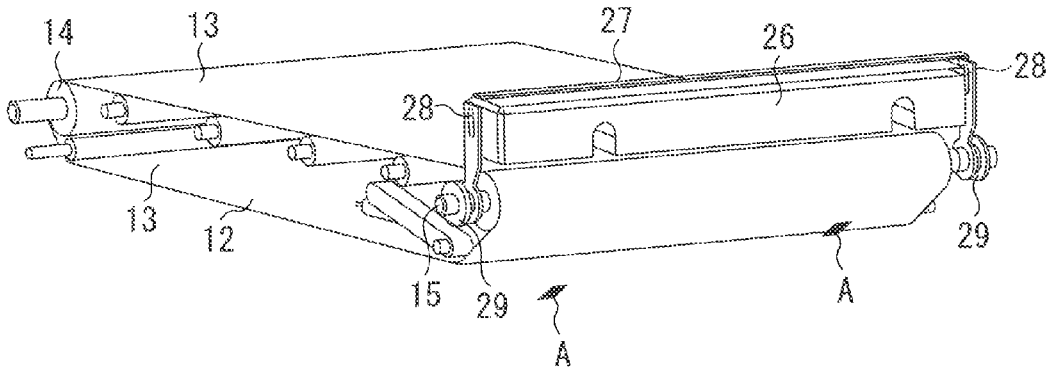
FIG. 2A is a perspective view illustrating a belt unit supporting a detection unit.
Figure 2B:
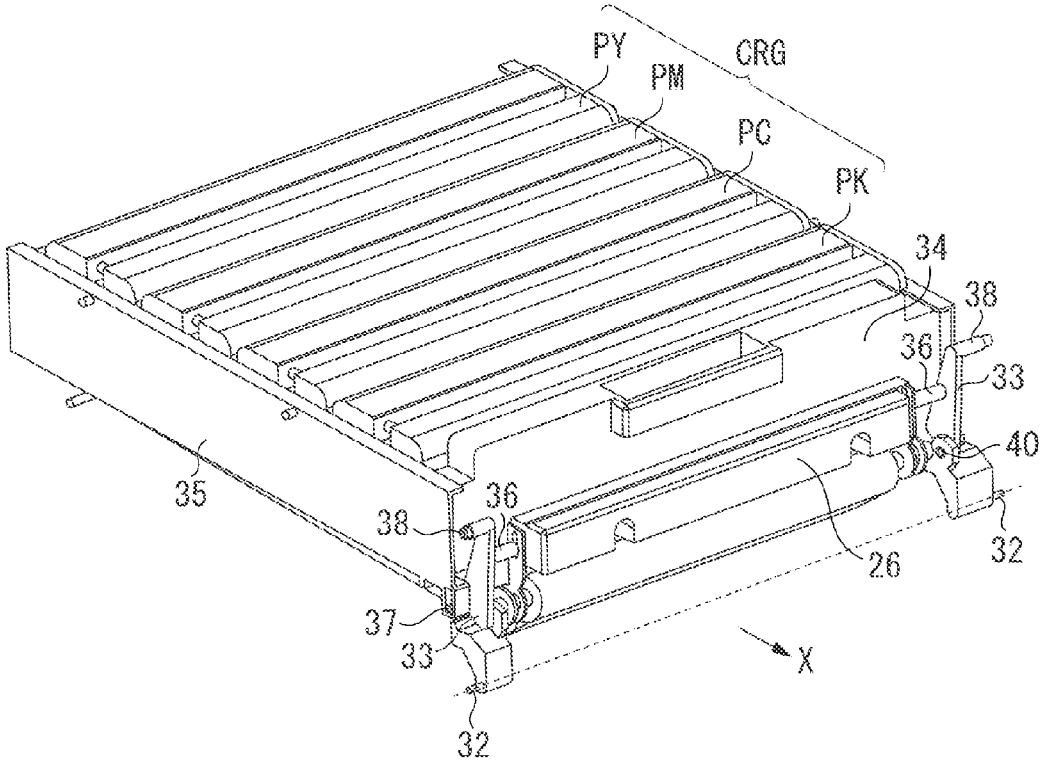
FIG. 2B is a perspective view illustrating a linkage mechanism between the detection unit and a door of the apparatus.
Figure 3:
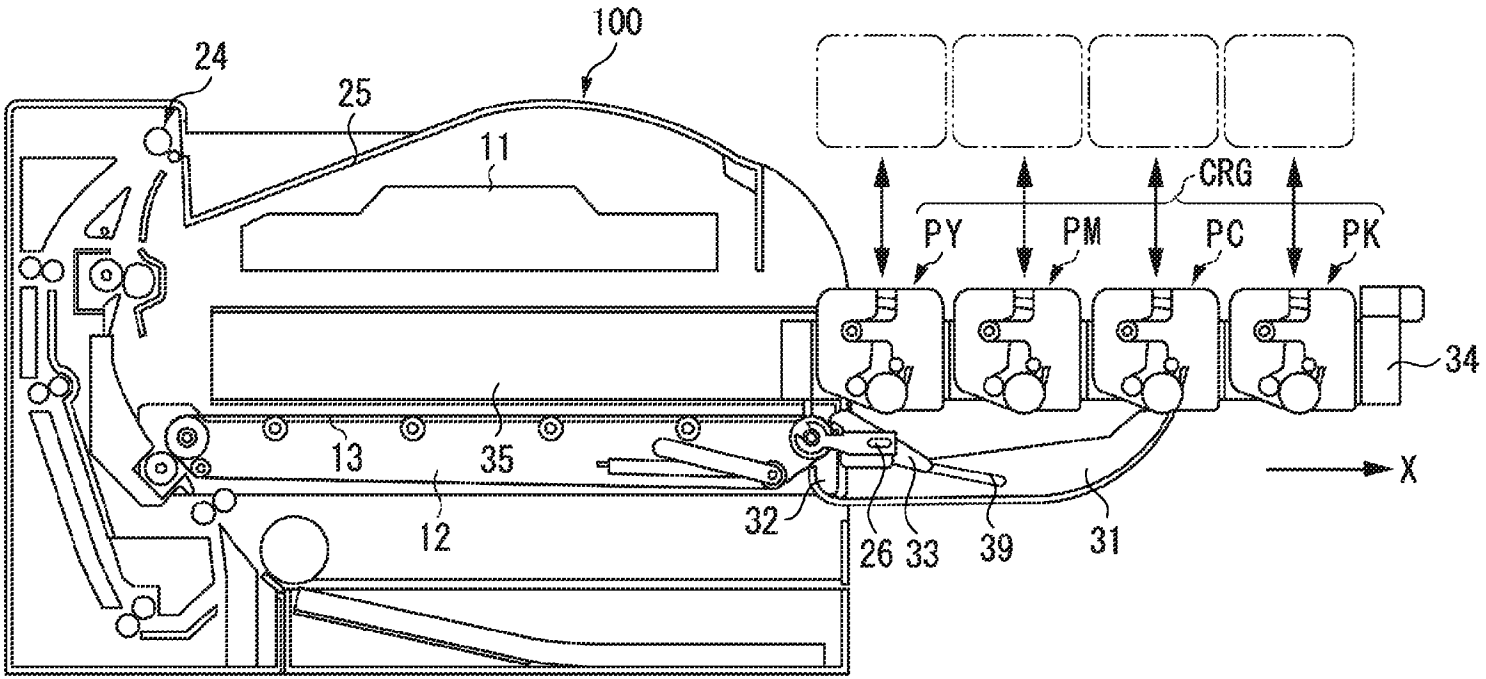
FIG. 3 is a cross sectional view schematically illustrating the image forming apparatus during attachment and detachment of cartridges.

The structure to cause the detection unit 26 to move for retraction is described. FIG. 2A is a perspective view illustrating the belt unit 12 supporting the detection unit 26. FIG. 2B is a perspective view illustrating a linkage mechanism between the detection unit 26 and the door 31. FIG. 3 is a cross sectional view schematically illustrating the image forming apparatus 100 during attachment and detachment of the cartridges CRG.

As illustrated in FIG. 2A, the detection unit 26 is supported by the belt unit 12, which stretches the belt 13, using the support member 27, which is a U-shaped plate. In other words, the detection unit 26 is fixed by the support member 27, and the support member 27 is supported, at the ends, by bearing members 29 that bear the turning roller 15.

The support member 27 is borne on the outside of the bearing members 29, and thereby can rotate approximately coaxially with the turning roller 15. This structure enhances the accuracy in coaxiality between the rotational axes of the support member 27 and the turning roller 15.

In the present exemplary embodiment, the detection unit 26 is arranged to move and retract in conjunction with opening/closure of the door 31, which opens/closes for attachment and detachment of the cartridges CRG. Next, the structure that enables the movement of the detection unit 26 in conjunction with opening/closure of the door 31 is described.

The cartridges CRG are supported on (accommodated in) the pullout tray 34. The cartridges CRG can be attached to and detached from the apparatus body by pulling out the pullout tray 34 from the apparatus body substantially along the direction in which the belt 13 is stretched (the direction X). The pullout tray 34 is movably supported on rails 35 relative to the apparatus body in the direction X, and is movable, while supporting the cartridges CRG, between the image formation position and the position where the cartridges CRG are attached or detached. As described above, the image forming apparatus 100 has the opening 30 at its front side, through which the pullout tray 34 is pulled out in the direction X. The door 31 is movable between the closing position where the door 31 closes the opening 30 and the opening position where the door 31 opens the opening 30. In other words, the door 31 moves between the closing position where the door 31 is closed and the opening position where the door 31 is opened, relative to the apparatus body around the door hinge 32, which is fixed to the apparatus body, to close/open the opening 30.

The door hinge 32 holds a door link 33 such that the door link 33 is rotatable around the rotation shaft 40 of the door link 33. The door link 33 has three shafts: a shaft 36 fitted in guide bores 28 of the support member 27, a shaft 37 fitted in the rails 35, and a shaft 38 fitted in the door link guide bores. The shaft 38 of the door link 33 is fitted in elongated door link guide bores 39 provided at the two ends of the door 31, and thereby the door link 33 rotates around the rotation shaft 40 of the door link 33 in conjunction with the openable and closable operation of the door 31.

The shaft 36 of the door link 33 is slidably fitted in the guide bores 28 provided at the both ends of the support member 27, and thereby the support member 27 rotates around the bearing members 29 in conjunction with the rotation of the door link 33. The shaft 37 is fitted in the rails 35 on the right and left sides of the pullout tray 34. The rails 35 move toward or away from the belt 13 in conjunction with the rotation of the door link 33. When the door 31 is opened, the rails 35 move away from the belt 13 in conjunction with the door link 33, and then the pullout tray 34 supported by the rails 35 moves away from the belt 13. This movement causes the cartridges CRG to be separated from a cartridge fixing unit (not illustrated) provided in the apparatus body, releasing the fixing of the cartridges CRG relative to the image forming apparatus.

The above structure enables the detection unit 26 to rotate around the bearing members 29 in conjunction with openable and closable of the door 31, which moves the pullout tray 34 away from or toward the belt 13, releasing the fixing of the cartridges CRG relative to the image forming apparatus.

Figure 4A:
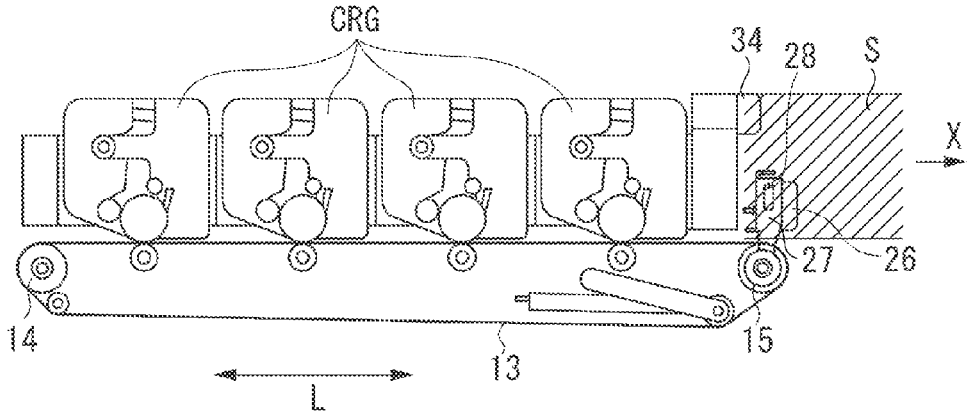
FIG. 4A is a cross sectional view schematically illustrating the position of the detection unit while the door is closed.
Figure 4B:
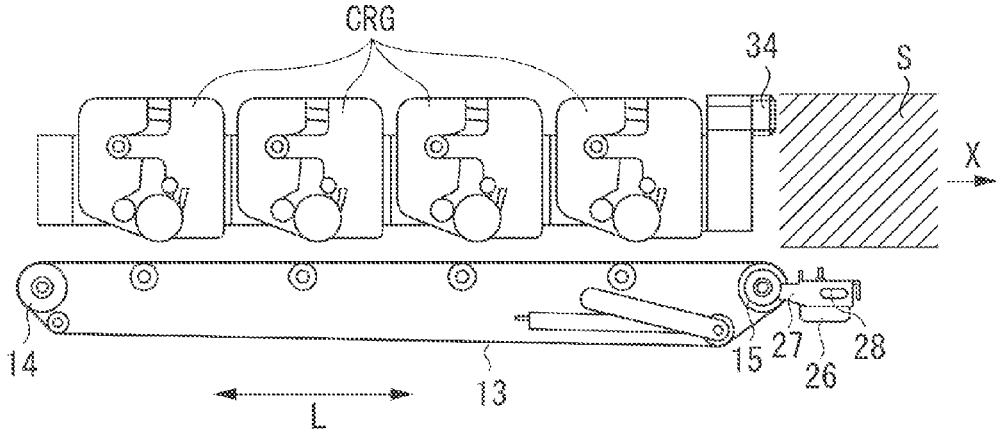
FIG. 4B is a cross sectional view schematically illustrating the position of the detection unit while the door is open.

The movement of the detection unit 26 during attachment and detachment of the cartridges CRG is described. FIG. 4A is a cross sectional view schematically illustrating the position of the detection unit 26 while the door 31 is closed. FIG. 4B is a cross sectional view schematically illustrating the position of the detection unit 26 while the door 31 is open. For illustrative purposes, in FIGS. 4A and 4B, only part of the image forming apparatus, such as the cartridges CRG, the belt 13, the pullout tray 34, and the detection unit 26, is illustrated.

As illustrated in FIG. 4A, while the door 31 is at the closing position relative to the apparatus body, the detection unit 26 is above the turn roller 15 and at a detecting position in line with the cartridges CRG in the direction L. In other words, the detection unit 26 is arranged on the movement track S of the cartridges CRG and the pullout tray 34. In this state, the detection unit 26 at the detecting position resides within the width of the belt 13 in the direction L.

When the door 31 is moved to the opening position from the closing position relative to the apparatus, the detection unit 26 rotates around the bearing members 29 in conjunction with the rotation of the door link 33 as described above, and moves to the position illustrated in FIG. 4B. In this state, the detection unit 26 is disposed out of the path where the cartridges CRG pass to be pulled out of the apparatus body on the pullout tray 34, and thereby does not disturb the pulling out of the pullout tray 34. In other words, the detection unit 26 is disposed at a retracted position away from the movement track S of the cartridges CRG and the pullout tray 34. The term "movement track S" herein refers to the space where the detachable cartridges CRG and the pullout tray 34 that moves with the cartridges CRG for attachment and detachment thereof pass, and where the cartridges CRG are attached/detached. The term "retracted position" herein refers to the location where at least part of the detection unit 26 is located (resides) in the space that is formed by opening the door 31.

Accordingly, the pullout tray 34 at the image forming position can be pulled out to the position for attachment and detachment of the cartridges CRG that resides outside of the apparatus 100, without disturbance of the detection unit 26. As a result, the attachment and detachment of the cartridges CRG can be achieved.

As described above, in the present exemplary embodiment, the detection unit 26 at the detecting position is located (resides) in the space for attachment and detachment of the cartridges CRG, and moves to the retracted position that is outside of the space for attachment and detachment of the cartridges CRG from the detecting position during attachment and detachment of the cartridges CRG. In addition, the detection unit 26 at the detecting position is located (resides) in the space that is formed by opening the openable and closable member relative to the apparatus body. In other words, by taking advantage of the fact that the detection unit 26 does not perform detection during attachment and detachment of the cartridges CRG, the detection unit 26 is disposed in the space for attachment and detachment of the cartridges CRG to perform detection. As a result, as compared to the cases where a space for a detection unit to perform detection and a space for attachment and detachment of cartridges are separately provided, the present exemplary embodiment can achieve further downsizing of the image forming apparatus. In other words, the detection unit 26 according to the present exemplary embodiment does not retract from the belt, which is an object the detection unit 26 detects, but retracts from the cartridges, which are not objects the detection unit 26 detects. The detection unit 26 is disposed, during detection, in the space for attachment and detachment of the members that are not the object the detection unit 26 detects, thus leading to downsizing of the image forming apparatus.

The detection unit at the detecting position, when at least a part of the detection unit is located in the space for attachment and detachment of the cartridges, allows further downsizing of the apparatus as compared to the conventional apparatus. Similarly, the detection unit at the retracted position, when at least a part of the detection unit is located in the space that is formed by opening the openable and closable member relative to the apparatus body, allows further downsizing of the apparatus as compared to the conventional apparatus.

Figure 5:
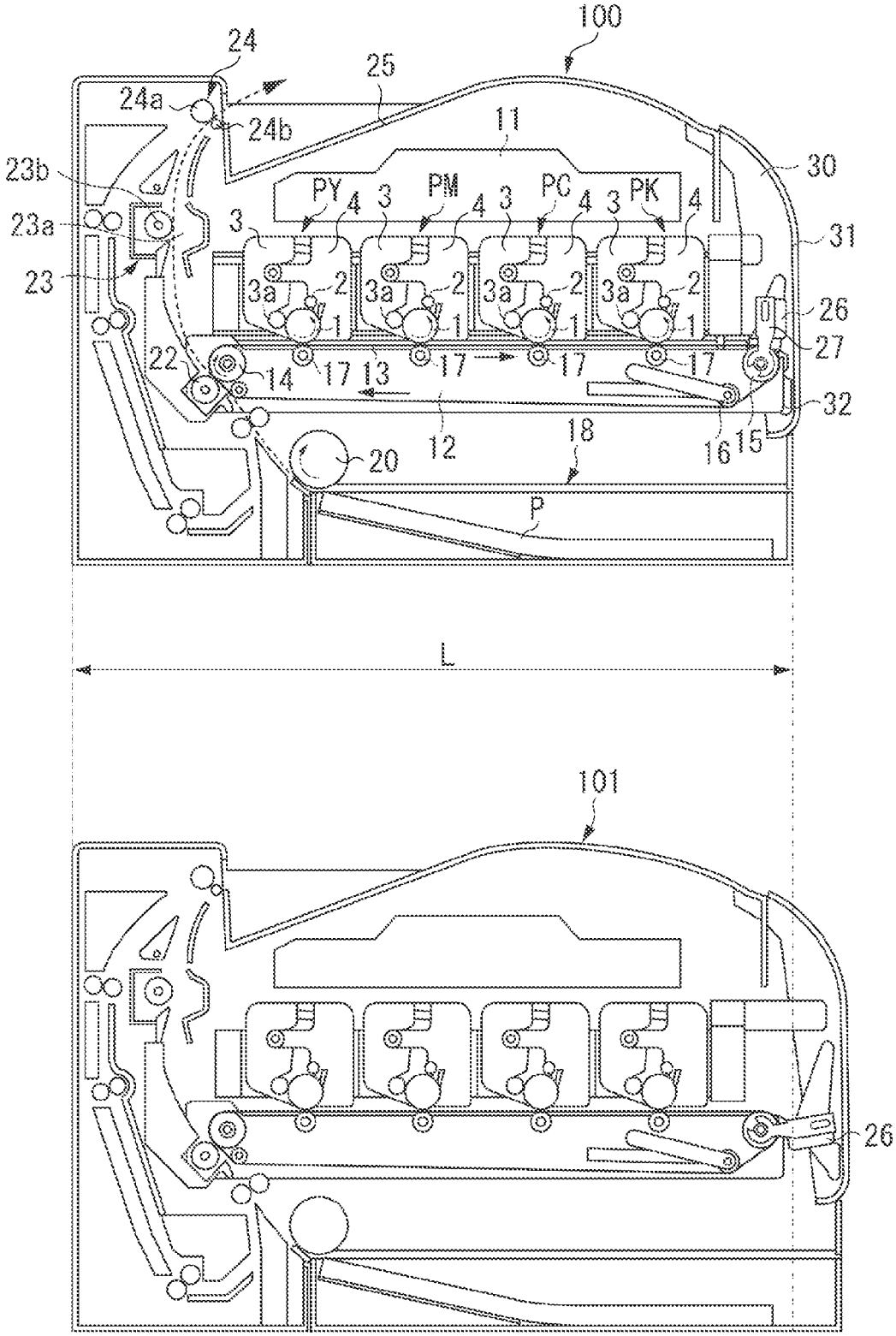
FIG. 5 is a cross sectional view schematically illustrating the image forming apparatus according to the first exemplary embodiment and a conventional image forming apparatus.

FIG. 5 is a cross sectional view schematically illustrating the image forming apparatus 100 according to the present exemplary embodiment (the upper one in FIG. 5), and a conventional image forming apparatus 101 (the lower one in FIG. 5). In the present exemplary embodiment, the detection unit 26 moves in conjunction with the door 31, and the detecting position of the detection unit 26 resides within the width of the belt 13 in the direction where the belt 13 is stretched (direction L) and also on the attachment and detachment track of the cartridges CRG. The retracted position of the detection unit 26 resides within the space that is formed by opening the door 31, and also away from the attachment and detachment track for attachment and detachment of the cartridges CRG. This structure achieves a decrease in the length of the image forming apparatus in the direction the belt 13 is stretched (direction L), and a decrease in the installation area of the apparatus, as compared with the conventional apparatus.

In the present exemplary embodiment, the detection unit 26 is supported by the support member 27, which is supported by the bearing members 29 of the turning roller 15, thus precisely aligning the detection unit 26 at the detecting position relative to the turning roller 15. This maintains detection accuracy of the detection unit 26 at high level. The detection unit 26 rotates around the rotational shaft of the turning roller 15 while moving between the detecting position and the retracted position, which securely supports the detection unit 26 while keeping it as a movable member, without the necessity of any additional rotational shaft. Slight misalignment, if any, of the detection unit 26 in detecting position in the rotational direction hardly changes the distance between the detection unit 26 and the part of the belt 13 to be detected because the detection unit 26 is supported by the bearing members 29 through the support member 27, which maintains the detection accuracy at high level.

In the present exemplary embodiment, the cartridges CRG are detached from the apparatus body while supported on the pullout tray 34, but, without the pullout tray 34, a user may directly remove the cartridges CRG from the apparatus body. In the present exemplary embodiment, the belt 13 is stretched horizontally, but may be stretched in another direction.

The cartridges CRG according to the present exemplary embodiment are process cartridges each including a photosensitive drum 1 and a process unit configured to act on the drum 1, but may be any other attachable/detachable members that can be attached to and detached from the apparatus such as image forming cartridges including toner cartridges and waste toner containers. In the present exemplary embodiment, the detection unit 26 moves in conjunction with opening/closure of the door 31, but may move in conjunction with shift of the pullout tray 34. The latter case also provides the same effect as in the present exemplary embodiment.

A second exemplary embodiment of the present invention is described. The belt 13 according to the first exemplary embodiment is an intermediate transfer member that transfers toner images transferred from the photosensitive drum 1 to the recording medium P at the secondary transfer nip portion N2. In the second exemplary embodiment, instead of the belt 13, a recording medium conveyer belt that conveys recording media is used. The other parts of the second exemplary embodiment are similar to those of the first exemplary embodiment, which are denoted with the similar reference numerals and are not repeated.

Figure 7A:
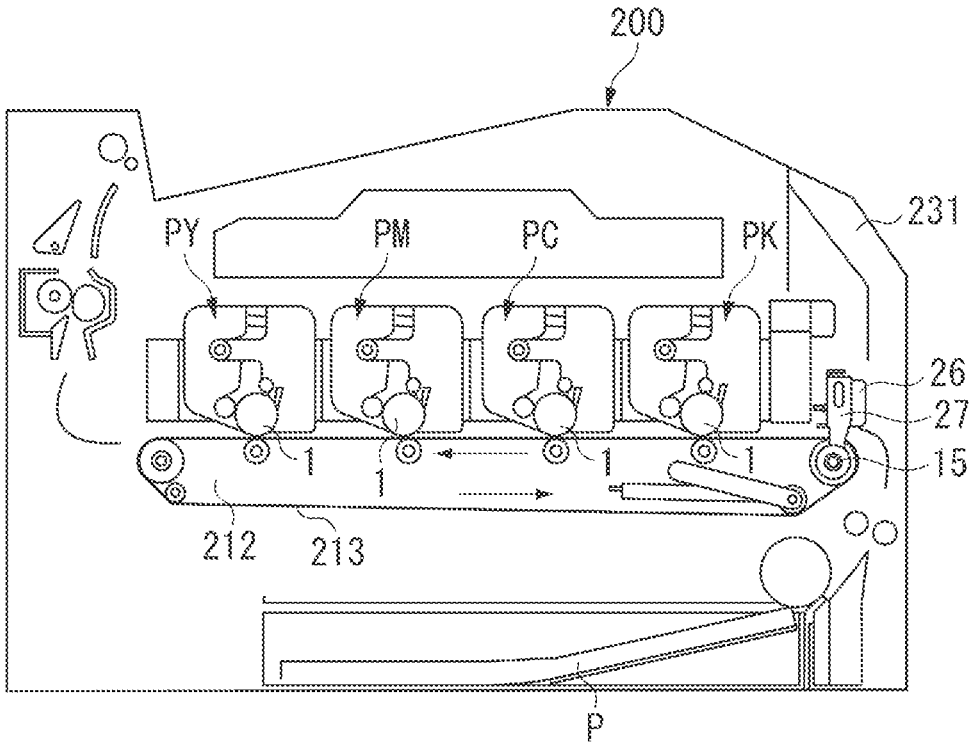
FIG. 7A is a cross sectional view schematically illustrating a detection unit in an image forming apparatus according to a second exemplary embodiment of the present invention while a door of the apparatus is closed.
Figure 7B:
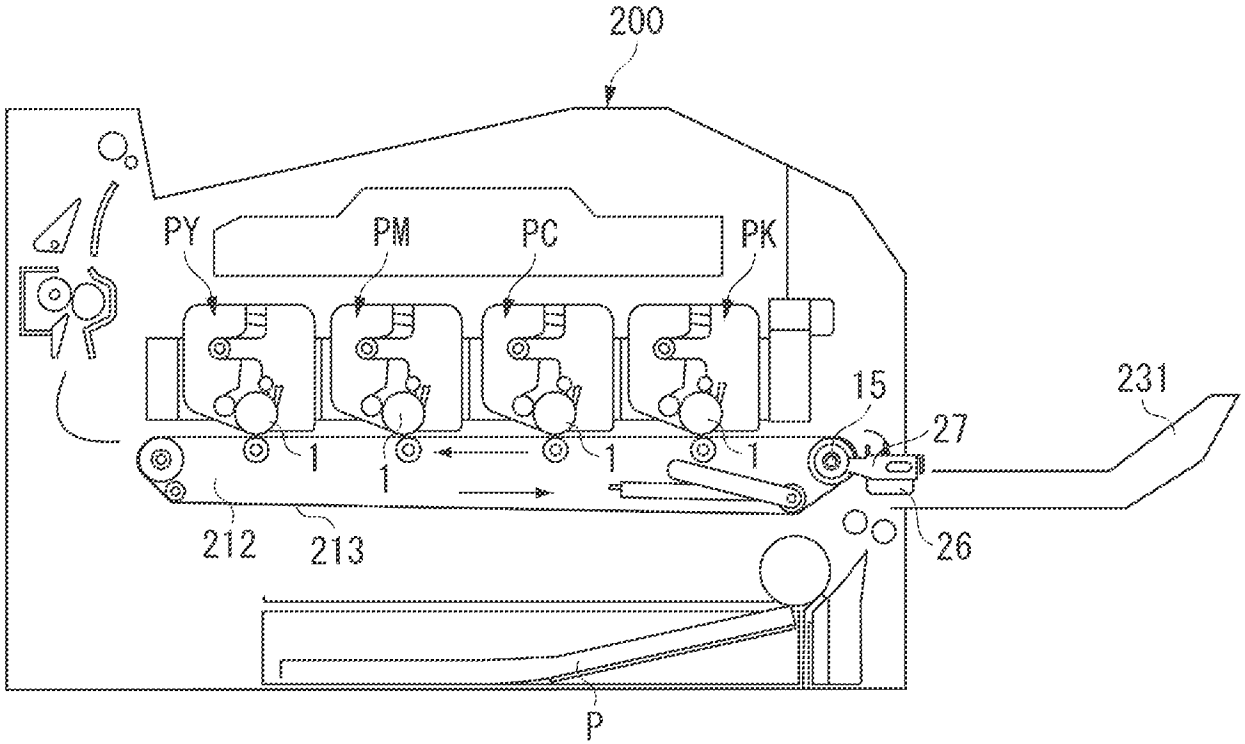
FIG. 7B is across sectional view schematically illustrating the detection unit in the image forming apparatus according to the second exemplary embodiment while the door is open.

FIGS. 7A and 7B are cross sectional views schematically illustrating an image forming apparatus according to the second exemplary embodiment while a door 231 of the apparatus is closed and the door 231 is open, respectively. An image forming apparatus 200 according to the present exemplary embodiment includes a belt unit 212 having a belt 213 as a recording medium conveyer belt that conveys recording media. The belt 213 electrostatically attracts and conveys a recording medium P that is fed thereto, so that the recording medium P passes through the nip portion between the photosensitive drum 1 of each of cartridges (PY, PM, PC, and PK) and the belt 213. During the passing, the recording medium P supported by the belt 213 receives toner images that are transferred thereto in sequence from the photosensitive drums 1 to overlap one another, which results in a toner image in four colors on the recording medium P. The obtained toner image is fixed to the recording medium P as in the first exemplary embodiment.

As in the first exemplary embodiment, the belt unit 212 includes a detection unit 26 configured to detect objects such as toner images on the belt 213 and recording media. When the door 231 moves from a closing position to an opening position relative to the apparatus, the detection unit 26 rotates around the axis of the roller 15 in conjunction with rotation of a door link (not illustrated), and moves to the position illustrated in FIG. 7B.

In this state, the detection unit 26 resides out of the path where the cartridges are detached from the apparatus while supported on a pullout tray, and thereby does not disturb the pulling-out of the pullout tray. In other words, the detection unit 26 is arranged at a retracted position away from the movement track of the cartridges and the pullout tray. The term "movement track" herein refers to the space where the cartridges and the pullout tray that moves with the cartridges for attachment and detachment thereof pass to attach/detach the cartridges, and where the cartridges are attached/detached. The term "retracted position" herein refers to the location where at least part of the detection unit 26 is located (resides) in the space that is formed by opening the door 31.

As described above, the present invention is applicable to the belt 13 as a recording medium conveyer belt to obtain the same effect as in the first exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-260530 filed Nov. 22, 2010 and No. 2011-226027 filed Oct. 13, 2011, which are hereby incorporated by reference herein in their entirety.

What is claimed is:

1. An image forming apparatus, comprising;

a rotatable belt used to form an image on a recording medium;

a detection unit configured to detect, at a detecting position, an object to be detected on the belt;

a cartridge including a photosensitive drum and configured to be attachable to and detachable from a main body of the apparatus independently of the belt; and an openable and closable member configured to be openable and closable relative to the main body of the apparatus to attach and detach the cartridge to and from the main body of the apparatus, wherein the detection unit is movable between a retracted position, which is outside of a space used for attachment and detachment of the cartridge, and the detecting position, and wherein, when the detection unit is at the detecting position, at least a part of the detection unit is located in the space used for attachment and detachment of the cartridge, and, when the detection unit is at the retracted position, at least a part of the detection unit is located in a space that is formed by opening the openable and closable member relative to the main body of the apparatus.

2. The image forming apparatus according to claim 1, wherein the detection unit moves from the detecting position to the retracted position in conjunction with opening of the openable and closable member relative to the main body of the apparatus.

3. The image forming apparatus according to claim 1, wherein the belt is stretched around a roller, and wherein the detection unit at the detecting position is located opposite the roller through the belt, and the detection unit rotates around an axis of the roller to move between the detecting position and the retracted position.

4. The image forming apparatus according to claim 3, further comprising a bearing member configured to bear the roller, wherein the detection unit is rotatably supported by the bearing member.

5. The image forming apparatus according to claim 1, wherein the cartridge includes a plurality of cartridges, each including a photosensitive drum and a process unit configured to act on the photosensitive drum, wherein the plurality of cartridges, when attached to the main body of the apparatus, are arranged in a direction in which the belt is stretched, and the belt is in contact with the photosensitive drums, and wherein the plurality of cartridges are attachable/detachable substantially along the direction in which the belt is stretched.

6. The image forming apparatus according to claim 5, wherein the belt is stretched around a roller such that a width of the belt in a horizontal direction is longer than that in a vertical direction, and wherein, at the detecting position, the detection unit is disposed above the belt, and overlaps the belt in the direction in which the belt is stretched as seen from an axial direction of the roller.

7. The image forming apparatus according to claim 6, further comprising a tray configured to be able to be pulled out of the main body of the apparatus and to accommodate the plurality of cartridges, wherein, when the tray is pulled out of the main body of the apparatus, the plurality of cartridge moves from an image forming position, where an image is formed in the main body of the apparatus, to an attachment and detachment position, where the plurality of cartridges is attachable to and detachable from the tray.

8. The image forming apparatus according to claim 1, wherein the detection unit detects a toner image formed on the belt, by illuminating the belt with a light beam and receiving the light beam reflected from the belt.

9. The image forming apparatus according to claim 8, wherein the image forming apparatus detects a positional deviation of another toner image relative to the toner image formed on the belt, based on an output of the detection unit.

10. The image forming apparatus according to claim 8, wherein the image forming apparatus detect a toner density of an image formed on the belt, based on an output of the detection unit.

* * * * *